United States Patent [19]

Bryant et al.

[11] Patent Number: 5,038,492

[45] Date of Patent: Aug. 13, 1991

[54] APPARATUS AND METHOD FOR MARKING LOCATIONS OF STUDS IN WALLS

[75] Inventors: Bruce A. Bryant, Yucca Valley; John Lo Verso, Corona, both of Calif.

[73] Assignee: Mitchell Mason Group, Inc., El Segundo, Calif.

[21] Appl. No.: 325,203

[22] Filed: Mar. 17, 1989

[51] Int. Cl.[5] ..... G01B 3/10; B44C 7/02

[52] U.S. Cl. ..... 33/758; 156/577; 156/579; 156/523; 206/411

[58] Field of Search ..... 33/758, 755, 757, 759; 206/411, 389; 156/523, 527, 574, 577, 579

[56] References Cited

U.S. PATENT DOCUMENTS

| | | | |
|---|---|---|---|
| 2,187,087 | 1/1940 | Leary | 33/137 |
| 2,512,285 | 6/1950 | Nippert | 33/137 |
| 2,781,584 | 2/1957 | Cederholm | 33/138 |
| 3,063,370 | 11/1962 | Eberhardt | 101/329 |
| 3,126,637 | 3/1964 | Short | 33/87 |
| 3,463,694 | 8/1969 | Roshia | 156/523 |
| 3,470,574 | 10/1969 | Heitman | 12/142 |
| 3,666,601 | 5/1972 | Wuerch | 156/579 |
| 4,022,651 | 5/1977 | Larkins et al. | 33/27.02 |
| 4,152,836 | 5/1979 | Rodrique | 33/87 |
| 4,367,590 | 1/1983 | Winter et al. | 33/758 |
| 4,406,730 | 9/1983 | Altmix | 156/577 |
| 4,460,433 | 7/1984 | Boyd | 156/574 |
| 4,555,298 | 11/1985 | Boucher | 156/523 |
| 4,608,116 | 8/1986 | Braselton | 156/523 |
| 4,660,291 | 4/1987 | Dehn | 33/414 |
| 4,679,325 | 7/1987 | Sweatman | 33/138 |
| 4,707,202 | 11/1987 | Sweeny | 156/523 |
| 4,806,184 | 2/1989 | Shannon | 156/523 |
| 4,845,858 | 7/1989 | Thomas | 33/759 |

FOREIGN PATENT DOCUMENTS 1026051 4/1966 United Kingdom .

*Primary Examiner*—William A. Cuchlinski, Jr.
*Assistant Examiner*—C. W. Fulton
*Attorney, Agent, or Firm*—Richard L. Gausewitz

[57] ABSTRACT

A strip of pressure sensitive tape is laid out along top and bottom plates or top and bottom tracks of a wall that is to be constructed with studs at a fixed spacing. The tape bears stud location marks at preselected intervals for ease in locating the studs for connection to the top and bottom plates and top and bottom tracks. The tape is provided in a supply roll that is rotatably mounted in an applicator tool having a handle and a pressure roller that enable the tape to be pressed against the plate or track and withdrawn from the roll as the tool and tape are moved along. To facilitate locating and positioning of the end of the tape, and therefore of the first stud location mark of the tape, the tool is provided with a pressure foot extending from the pressure roller and has an edge which may easily be positioned at the desired starting point of the tape, as, for example, against an existing wall. Means are provided to hold the end of the tape against the pressure foot with a first stud location mark at the pressure foot end for initial positioning of the tape.

15 Claims, 7 Drawing Sheets

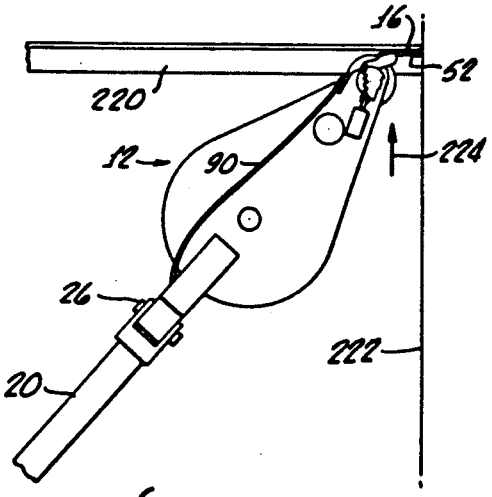
FIG. 13a.
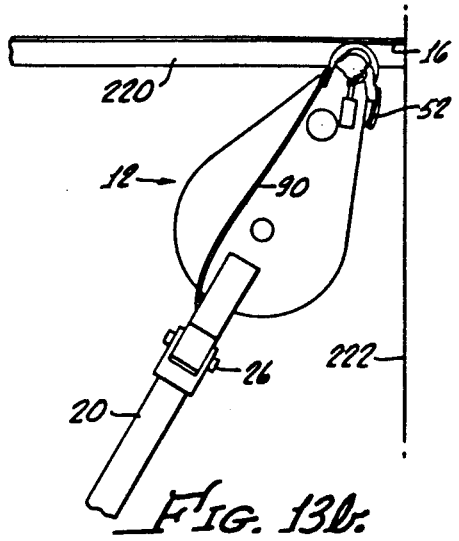
FIG. 13b.
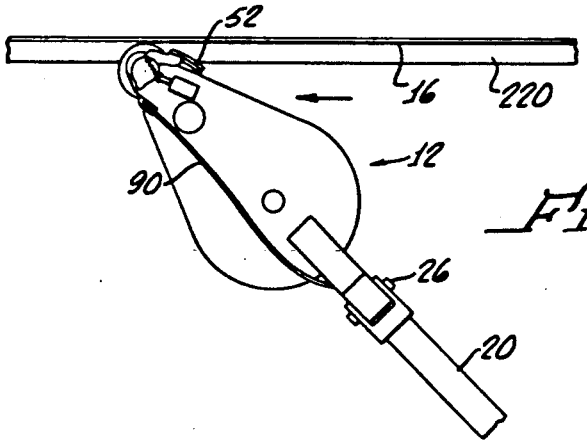
FIG. 13c.
FIG. 14.
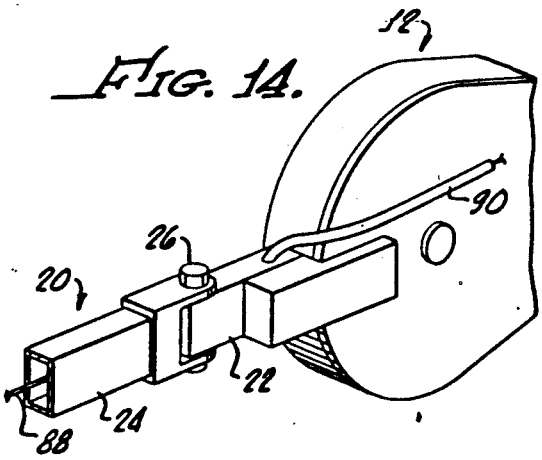
FIG. 15.
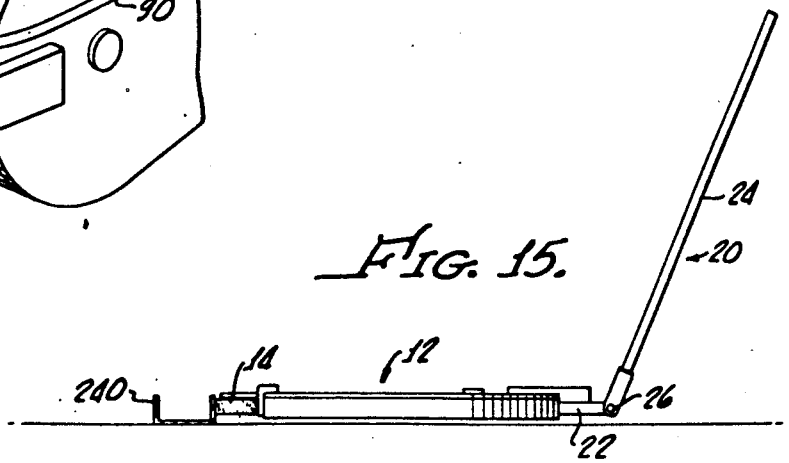

APPARATUS AND METHOD FOR MARKING LOCATIONS OF STUDS IN WALLS

BACKGROUND OF THE INVENTION

The present invention relates to building construction, and more particularly concerns methods and apparatus for facilitating layout and marking of building wall stud locations.

Building walls in residential construction are commonly formed of two-by-four vertical studs between two-by-four top and bottom plates. In commercial construction, such as highrise office buildings, hotels, hospitals, and industrial complexes, C-shaped metal track is used for top and bottom plates and studs. The studs, whether of two-by-fours, for residential construction, or C-shaped metal track for commercial construction, are secured in vertical positions to the plates or tracks at top and bottom and spaced at fixed distances from one another. For properly spaced and vertical studs, both the top and bottom of each stud must be accurately located. Location of the top and bottom ends of the studs by methods presently used is both time consuming and subject to inaccuracy. Generally a tape measure is laid out along the plate or track, and the person marking a bottom plate or track, will stoop and make the appropriate marks on the plate or track at the selected spacing, such as, for example, sixteen inches, along the tape measure for the entire length of the wall. Sixteen inch spacing is commonly used because plywood and wallboard panels, the most common wall surface materials, are generally four feet in width, and it is desired to have the studs positioned at the edges of the panels, where one panel adjoins an adjacent panel. It is also desired to have intermediate studs evenly spaced. The stooping for marking of a bottom plate or track is difficult and laborious, particularly for long stretches of wall, and tends to introduce marking errors which may accumulate over a long wall. Even more difficult, laborious and time consuming is the marking of the track at the top of a commercial wall, which requires use of a bench or scaffolding to enable the person making the upper stud location marks to frequently mount and dismount to and from the bench or to walk along a higher scaffolding. The need to climb up and down for the overhead marking also entails greater risk of injury. Moreover, the difficulty of securely and fixedly holding a tape measure in place over head without moving it is at least partly the cause of many tape marking errors. Unless both top and bottom plates or upper and lower tracks are precisely and similarly marked, the upper marks will not be vertically in line with the lower marks, and the studs will be out of plumb. With the studs out of plumb, edges of wall panels are not in the center of the studs, resulting in costly errors and improperly installed walls.

Although premarked gummed tape has been suggested, as, for example, in the U.S. Pat. No. 2,187,087, to Leary, such tape has not been widely used because of difficulties in applying the tape at the desired locations. In particular, the required hand application of such tape to an upper track of a metal stud wall, of the type commonly used in commercial construction, would be difficult and time consuming and subject to error. Further, as tape is pulled off the roll, it is under significant tension, which may stretch the tape, resulting in errors accumulating to large amounts over the extent of a wall that may be many tens of feet in length.

Accordingly, it is an object of the present invention to provide a method and apparatus for layout of wall studs that avoids o eliminates above-mentioned problems.

SUMMARY OF THE INVENTION

In carrying out principles of the present invention in accordance with a presently preferred embodiment, a roll of tape is provided, having pressure sensitive adhesive on one side and stud locating marks on the other. The tape roll is rotatably mounted in an applicator which has a long handle and a pressure roller. Tape is payed out under the roller as the applicator is moved. Thus, the entire length of tape may be payed out by an operator holding the applicator and standing in a substantially upright position, even when applying tape to a ceiling plate or track that may be as much as fourteen feet above the floor. According to one feature of the invention, the tape roll, pressure roller and handle collectively form a tape applicator to which a movable pressure foot is mounted to assist in starting the tape with a stud location mark of the tape precisely positioned at the desired location of the first stud. The pressure foot has an end at which the first mark on the tape is positioned. This pressure foot end can be positioned precisely at the desired start point, whether such start point be at an adjoining transverse wall or some other position defining element. Preferably, the pressure roller also acts as a power roller which is pressed down against and rolls along the plate or track upon which the length of tape is to be adhered. This roller acts both to press the tape to ensure its adhesive securement and to rotate a tape roller drive so as to provide a powered withdrawal of tape from the roll.

BRIEF DESCRIPTION OF THE DRAWINGS

FIGS. 13*a*, 13*b* and 13*c* illustrate a sequence of steps involving use of the pressure foot to start laying a section of tape at a cross wall;

FIG. 14 shows the handle pivot joint; and

FIG. 15 shows use of the applicator with the body at an angle to the handle.

DETAILED DESCRIPTION OF THE INVENTION

Figures 1, 2:
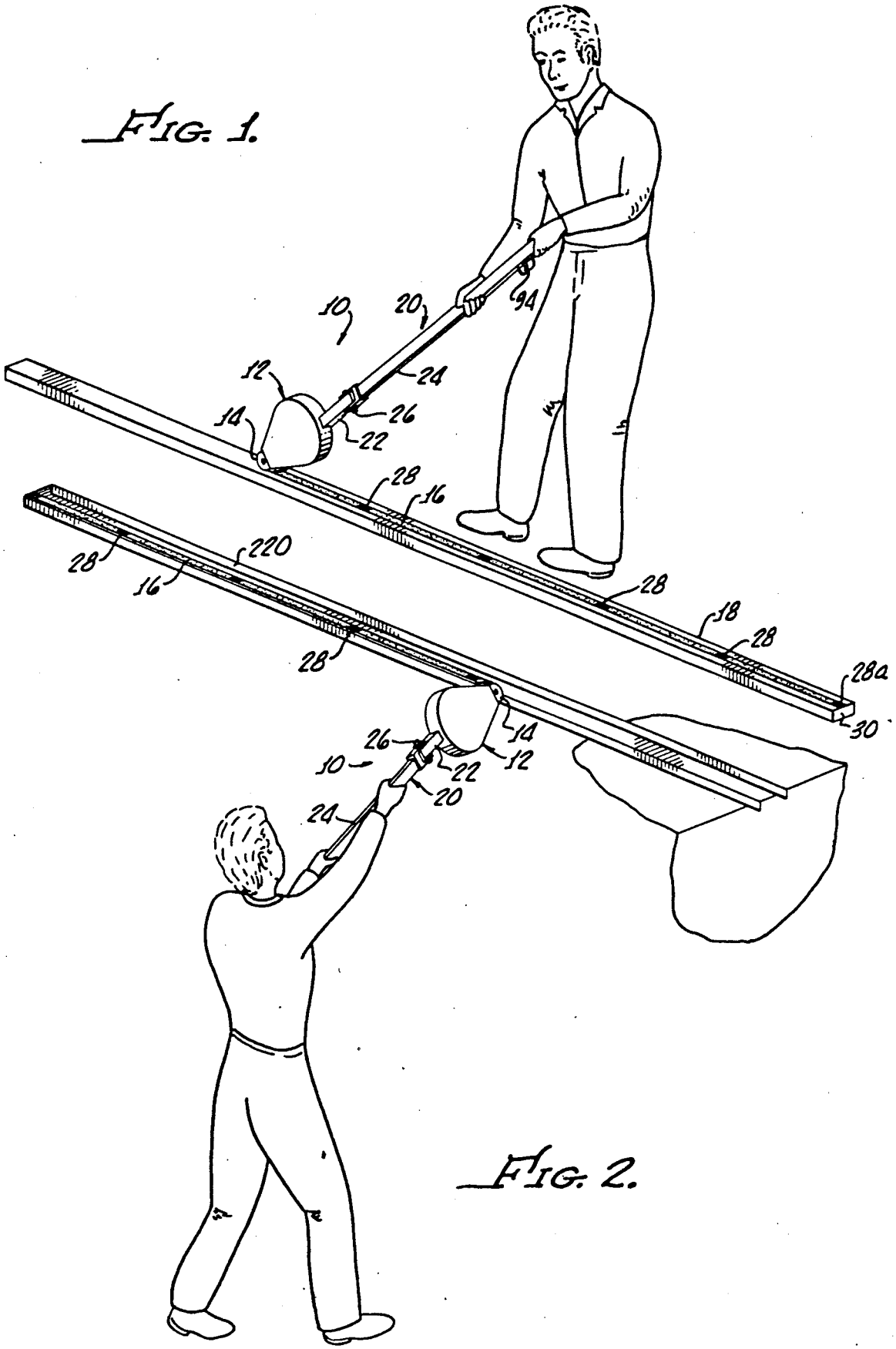
FIGS. 1 and 2 show application of tape, with methods and apparatus of the present invention, to lower and upper plates or tracks.

FIG. 1 illustrates use of a tape applicator employing principles of the present invention for application of stud location marks to a two-by-four plate. Although the tape is shown as applied to the three and one-half inch side of the two-by-four, it will be readily understood that it may be applied alternatively to the narrower one and one-half inch side if the plate is turned on edge. The tape applicator 10 includes an applicator housing 12 having a protruding power/pressure roller 14 over which tape 16 is drawn. The tape is pressed against a plate 18 as the tape is unrolled along the length of the plate, and thus adhesively secured thereto. Tape is carried in the housing 12 on a supply roll (not shown in FIG. 1), and is withdrawn from the roll so as to be passed over and then under the pressure/power roller 14 and onto the upper surface of the plate 18. Preferably, the applicator has an elongate handle 20, including a short section 22, that is fixedly secured to the housing 12, and has a longer manually manipulatable hand portion 24 that is connected to the fixed section 22 for angular adjustment about a pivot 26.

Tape 16 is formed of a substantially inextensible material to minimize tape stretch. It has a plurality of evenly spaced stud location marks 28 on one surface or side (the upper surface or side when the tape is adhered to a lower plate), and has the other side (the inside of the roll) thereof provided with a coating of a pressure sensitive adhesive. The adhesive side of the tape is on the outside of pressure roller 14 as the tape is withdrawn from the roll, so that the adhesive may be pressed against the surface of the plate to cause the tape to be adhesively attached to the plate.

In using of the applicator, a small amount of tape is first withdrawn from the roll, and the end of the tape is severed and precisely at a first one 28*a* (FIG. 1) of the stud locating marks. The tape end and first mark 28*a* are pressed down against the plate 18 at the end 30 of the plate 18, or at another location that identifies the desired position of a first stud. Where the studs are one and one-half inches in thickness, which is the actual thickness of the common two-by-four lumber, the marks 28 and 28*a* preferably have longitudinal dimensions equal to the stud thickness, namely one and one-half inches. The tape may have a width of about three-quarters of an inch.

Having precisely positioned the first stud locating mark 28*a* at the exact position where the first stud is to be located, pay out of tape from the roller is caused to commence by moving the applicator along the plate, with the applicator handle at a comfortable angle. This enables the operator, standing upright, to push the applicator ahead of him also downwardly to cause the tape to be pulled tight upon and along the sill plate. However, since the tape is made of an inextensible material, such as a strong paper or plastic, and thus will not stretch by any significant amount, the spacing of adjacent marks 28 remains as predetermined. Accordingly, all of the marks 28 are precisely positioned at the predetermined spacing, and the stud location marks are simply, rapidly, easily and accurately established.

A similar method is employed for laying tape on the downwardly facing surface of a plate or track that has been affixed to a ceiling. Thus, as illustrated in FIG. 2, the applicator is positioned overhead, again with the operator holding the handle, which extends at an angle to the direction of motion. The operator and presses the applicator upwardly and forwardly to withdraw tape from the roll and to press it upwardly against and along the downwardly facing surface of the ceiling track. Again the operation is simple, convenient, easy and accurate. No laborious and error inducing stooping is needed to lay the tape on a lower track or plate, and no time consuming, laborious and dangerous climbing up and down benches or walking along a scaffold is needed for marking an upper plate or track. As will be noted below in the course of detailed description of s the applicator, the power/pressure roller 14 may be mechanically connected to a tape drive so as withdraw tape from the roll without undue tensioning, and to enable tape to be precisely withdrawn and paid out at a steady, even rate.

As illustrated in FIGS. 3, 4, 5 and 6, applicator housing 10 includes an applicator body 32, which may be formed of a rigid metal plate having suitable strength to mount the described parts, and which carries a tape roll mounting shaft 29 capable of receiving a roll 36 of tape. Tape withdrawn from the roll 36 is led over an idler roller 37, rotatably mounted on body 32, and thence to primary and secondary tape drive rollers 39,56. Roller 39 is fixed upon a shaft 34 which is rotatably mounted to the body or plate 32.

Shaft 34 also has fixed thereto a toothed drive roller or gear 40 (see FIG. 6) the teeth of which mesh with a connecting gear 42 also rotatably mounted to the applicator body 32. Power/pressure roller 14 has a solid metallic or plastic inner portion 44 rotatably mounted on a shaft 46, which is fixed to the applicator body 32. Also fixed to the shaft 46 for rotation with the shaft and with the power/pressure roller is a driving gear 48. Gear 48 is rotatably mounted to plate 32 and has its teeth meshed in driving relation with connecting gear 42.

Pivotally mounted on a pin 50 (FIG. 6) carried by a swinging arm 52, which itself is pivoted to the applicator body on a pin 54, is the secondary drive roller 56. Roller 56 is spring urged toward the outer surface of primary drive roller 39 by a spring 45. Such spring is connected at one end to the applicator body plate 32, and at the other end to the pin 50 to resiliently urge secondary drive roller 56 against the primary drive roller 39 (FIG. 3).

Tape is withdrawn from the rotatable roll 36 and passed over idler roller 37. From idler roller 37 the tape is drawn to the primary drive roller 39. Roller 39 has flanges 67,68 (FIG. 4) on either side thereof which extend radially outwardly from the roller peripheral surface, which is generally indicated at 41 (FIG. 3), over which the tape is entrained. Secondary drive roller 56 is positioned between the drive roller flanges, the tape pressed being between the outer surface of auxiliary roller 56 and the peripheral surface 41 of drive roller 39.

Figure 3:
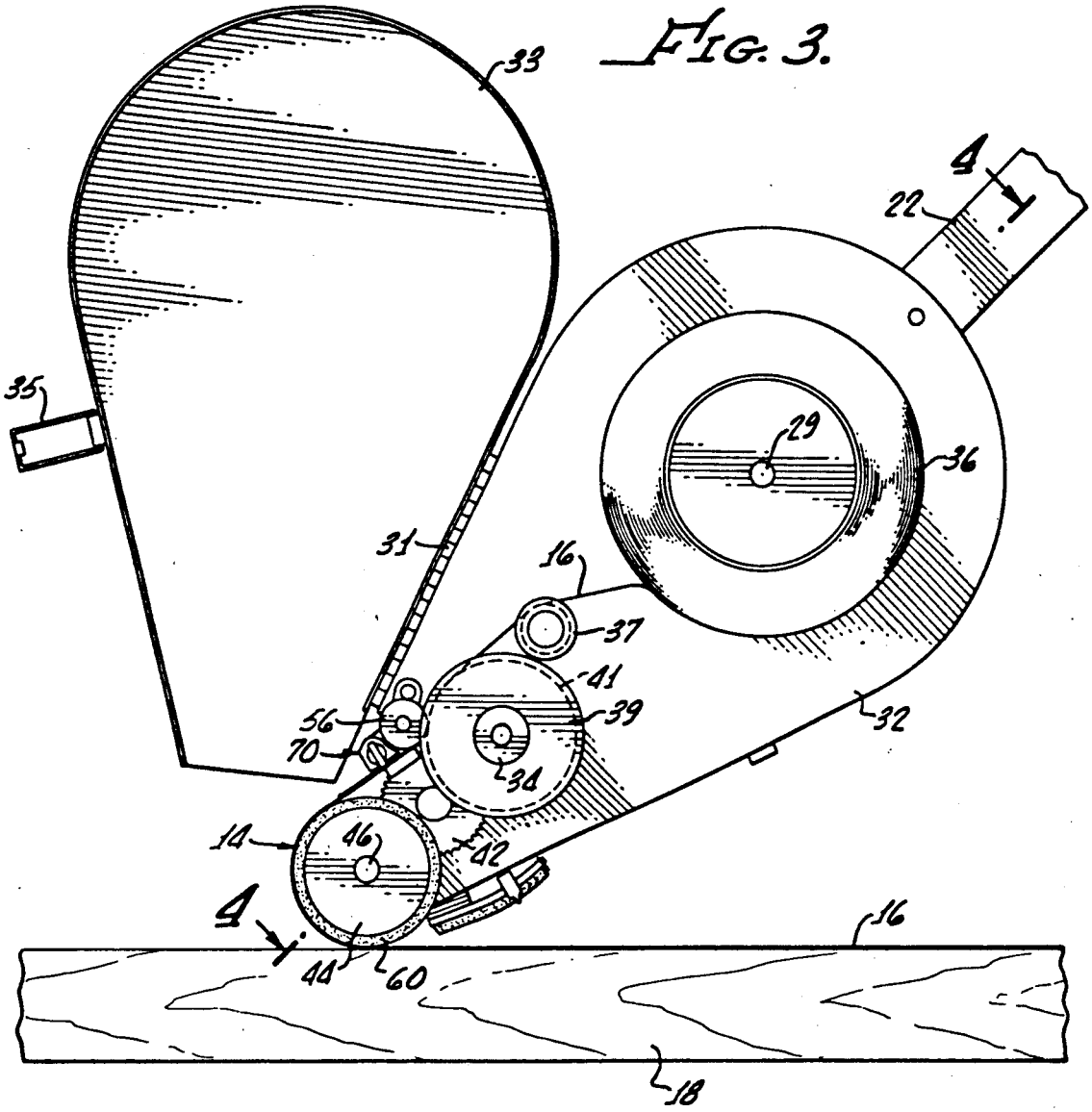
FIG. 3 is a side elevational view of portion of the tape applicator apparatus of FIGS. 1 and 2, with the applicator cover in open position to expose the inner mechanism.
Figure 4:
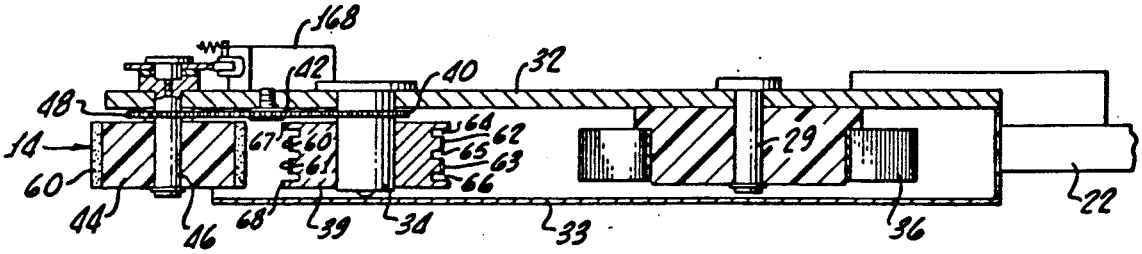
FIG. 4 is a section taken on lines 4—4 of FIG. 3.

As best seen in FIG. 4 and in the dotted line showing of FIG. 3, primary drive roller 39 has its surface 41 formed with a plurality of lands 60,61. These have nonslip coatings, such as a coarse, rough surface paper 62,63, which are separated by grooves 64,65,66 from each other and from the roller flanges 67,68. The surface of auxiliary roller 56 bears against the roughened coatings 62,63 between the primary drive roller flanges 67,68.

An applicator cover 33 is pivoted to the body plate 32 by an elongate set of hinges 31, and is locked to the body by a releasable latch 35.

Figure 6:
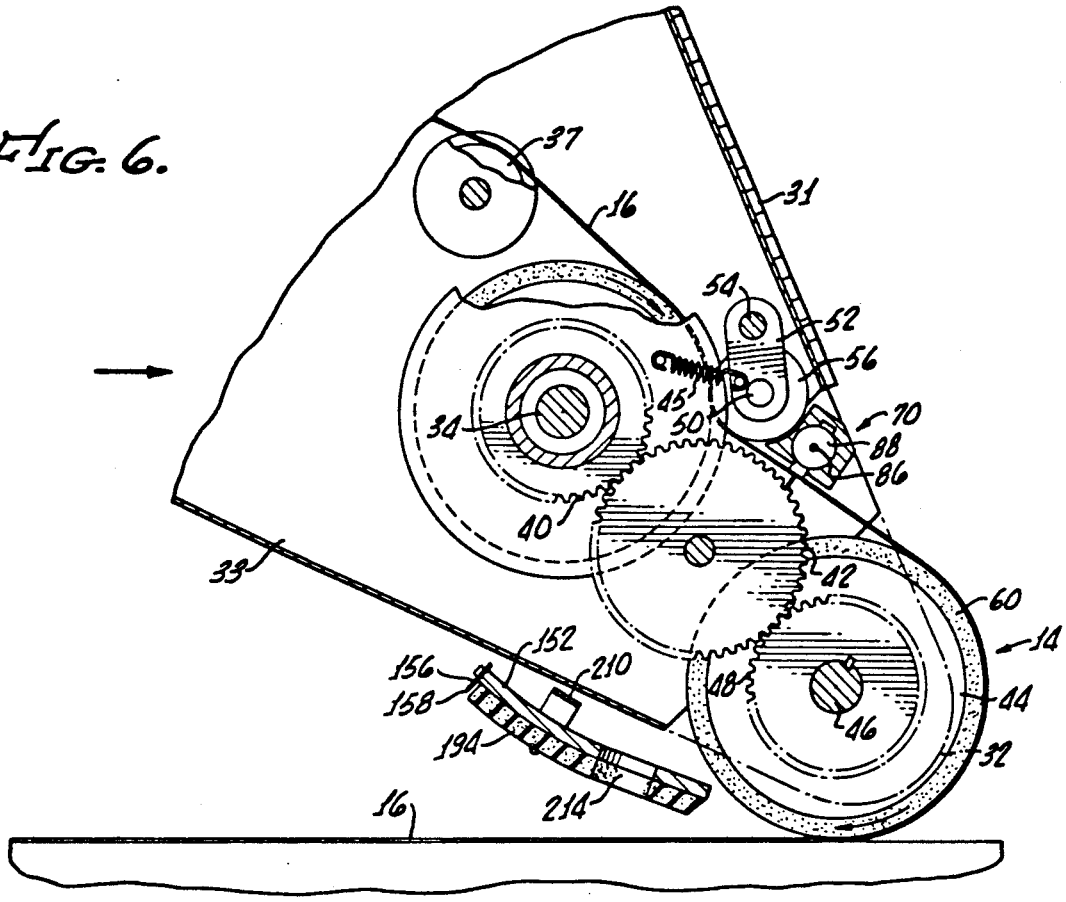
FIGS. 5 and 6 illustrate the applicator and certain steps in the operation of the applicator pressure foot and its automatic release of the tape.
Figure 5:
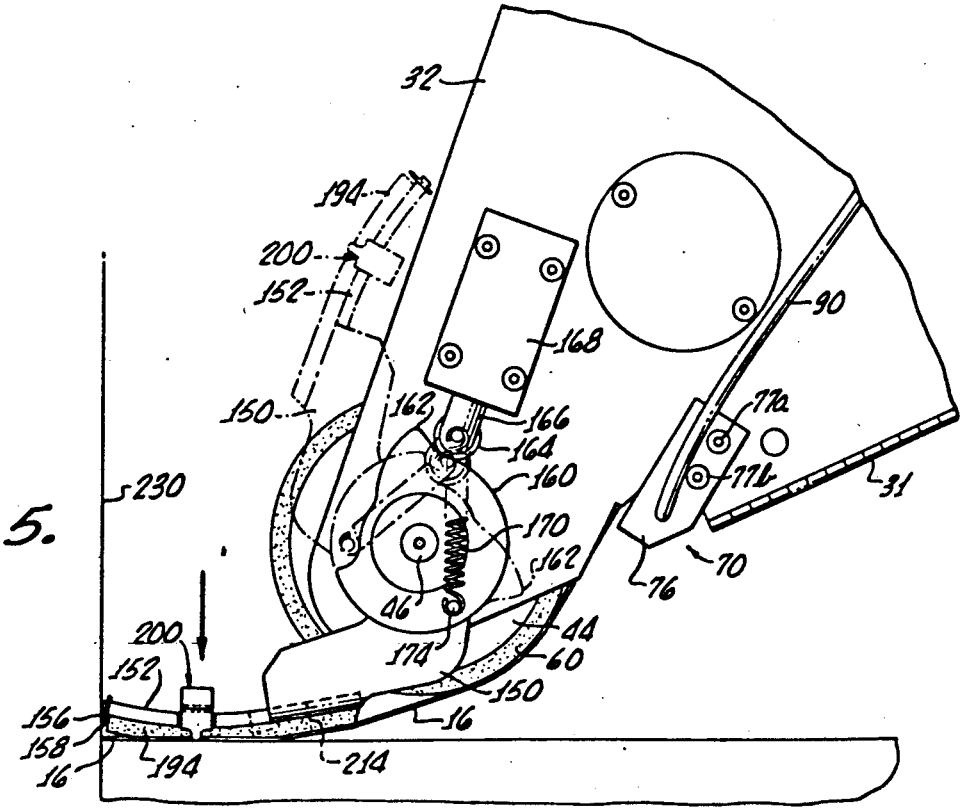
Figure 7:
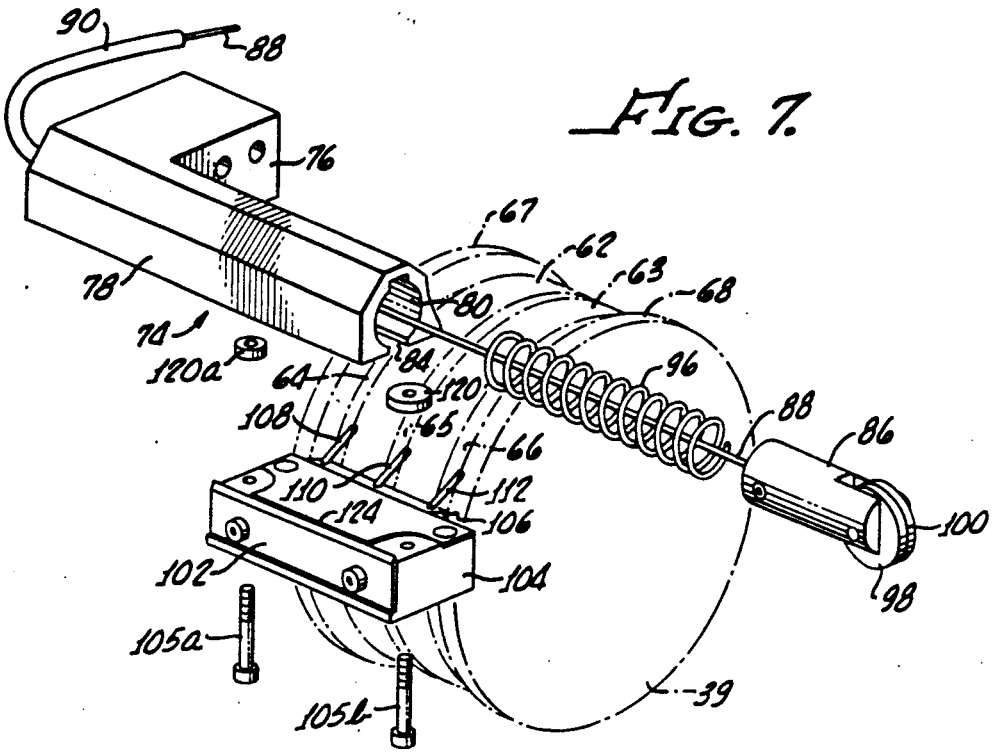
FIG. 7 is an isometric view showing details of the cutting mechanism.
Figure 8:
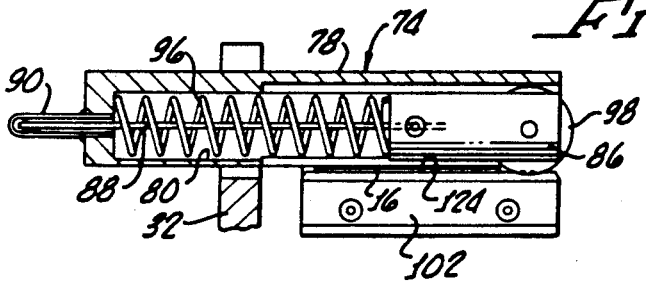
FIG. 8 is a sectional view of the blade, the cutter wheel and the carriage.
Figure 9:
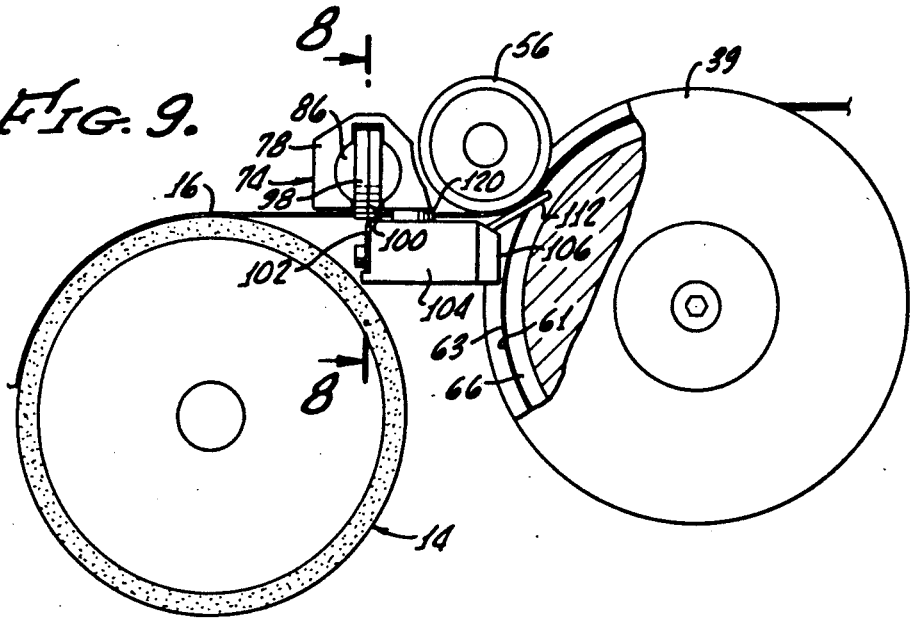
FIG. 9 is a side elevational view of parts of the applicator, showing the tape cutting mechanism.
Figure 7:
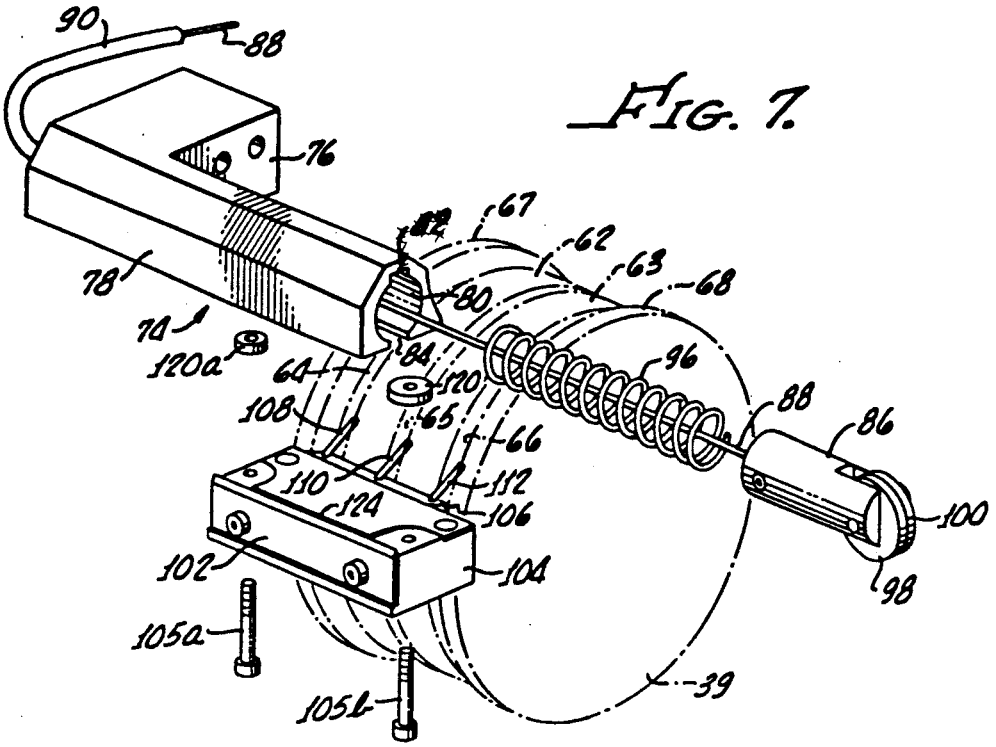
Figure 8:
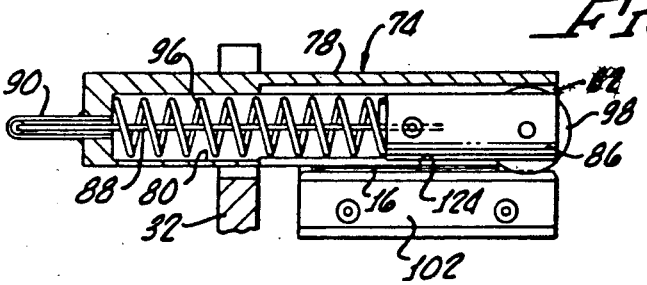
Figure 9:
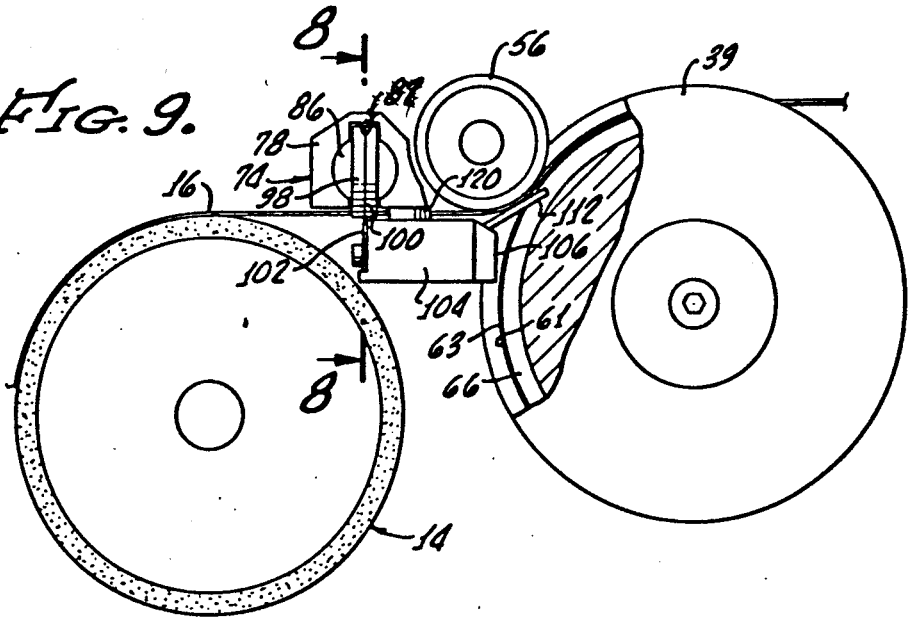
Figure 10:
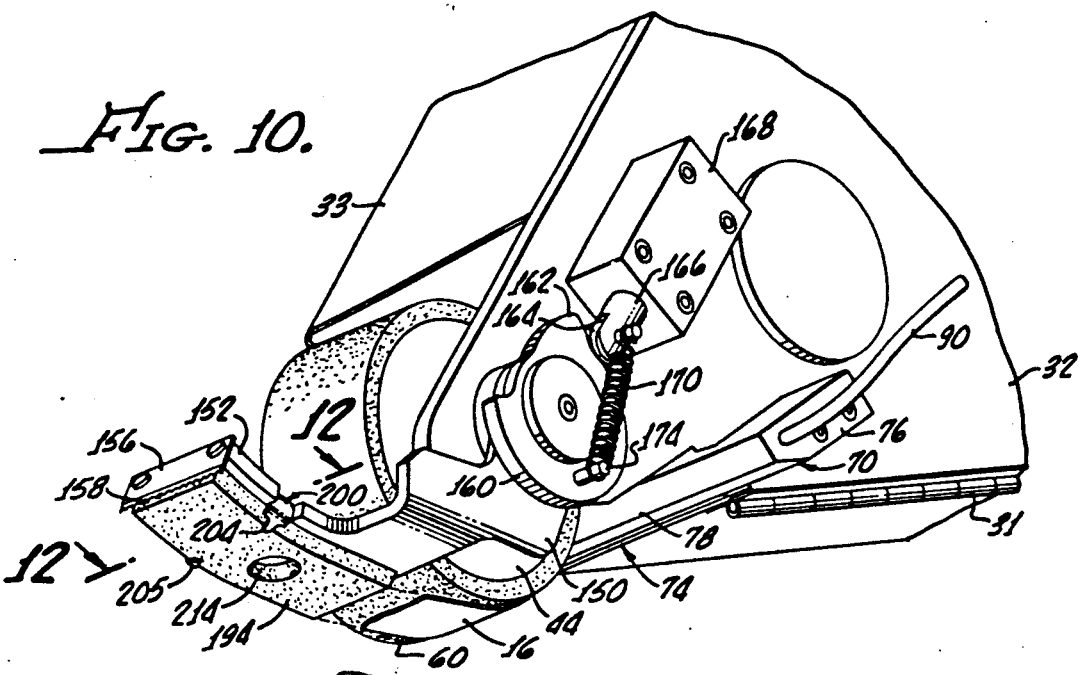
FIG. 10 is an isometric view of the applicator with pressure foot extended.
Figure 11:
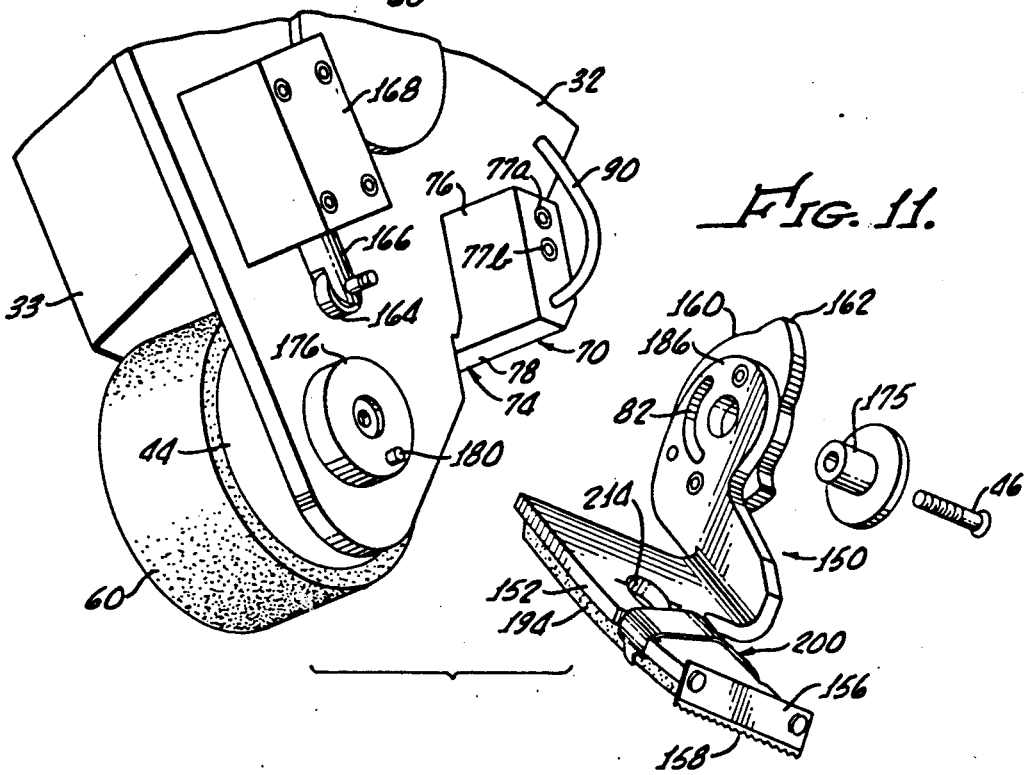
FIG. 11 is an exploded isometric view, showing parts of the pressure foot over-the-center cam mechanism.

Tape drawn from the tape roll 36 by the drive rollers 39,56 is fed past a cutting station 70 (FIG. 6). Such station 70 is mounted to the applicator body at a location between the power/pressure roller and the drive rollers. The cutting station is illustrated in detail in FIGS. 7, 8 and 9.) FIG. 7 shows an L-shaped cutter body 74 having a connecting leg 76 that is bolted to the outside of body plate 32 by bolts 77*a* and 77*b* (FIGS. 5 and 11). Body 74 also has a primary leg 78 in which is formed an elongate bore 80, of generally circular cross section, extending the length of leg 78 (FIG. 8).

Bore 80 has a longitudinal opening at a lower portion thereof. Slidably mounted in bore 80 is a cylindrical carriage 86; having a pull cable 88 secured to an outer end thereof. Cable 88 extends from the cutter body 74 through a cable housing 90, which extends upwardly along the applicator housing and through a part of the handle (see FIG. 14) to a handle trigger 94 (FIG. 1). This enables an operator holding the handle part 24 to pull on the cable and thereby pull the cylindrical carriage 86 from one end of the bore 80 to the other. Interposed between the outer end of the bore and the outer end of carriage 86 is a compression spring 96 that drives the carriage 86 back toward the inner end of the cutter bore 80.

Carriage 86 rotatably carries a roller 98, having a shallow peripheral groove 100 (FIG. 7) that cooperates with a cutter blade 102 which is fixed to an inner edge of a cutter block 104. Block 104 which is fixed to the cutter body leg 78 by bolts 105*a*,105*b*. The side 106 of cutter block 104 that faces toward the direction from which the tape is approaching block 104, fixedly carries a plurality of transversely spaced guide fingers 108,110,112 that extend into the recesses 64,65,66, of the primary drive roller 39. The fingers have concavely curved guide surfaces to guide the tape as it comes from between the drive rollers 39,56, as can be best seen in FIG. 9. The guide fingers 108,110,112 help to thread the end of the tape between the drive rollers 39,56 and ensure that the tape end, as it is initially threaded through the drive rollers, is directed over the tape cutter block and over the cutter plate blade 102.

Interposed between cutter body leg 78 and cutter block 104 are spacers 120,120*a* that provide a space between the cutter leg 78 and block 104 to receive the tape 16 as it is driven from between the drive rollers 39,56 and guided by the fingers 108,110 and 112.

In the operation of the cutter, the cylindrical carriage 86 and roller 98 are normally held by spring 96 at the inner end of cutter leg 78, as shown in FIG. 8. With the tape is in position over block 104 and extends under the cutter leg 78, pulling on the trigger 94 causes cable 88 to pull the carriage 86 toward the other end of bore 80. This compresses spring 96, and draws the cutter roller 98 over the length of the cutting edge 124 of blade 102. The cutting edge 124 thus severs the tape and projects slightly into the shallow groove 100 in the cutting roller 98, which is then returned to its starting position by spring 96 upon release of the trigger and cable.

A pressure foot is movably mounted to the applicator as shown in FIGS. 5, 6, 10, 11 and 12. Pivotally mounted on the shaft 46 (FIG. 5), which mounts the pressure/power roller 14, is a somewhat L-shaped pressure foot bracket 150. This carries an integral forwardly projecting pressure foot 152. Foot 152 has at its end a cutting blade 156 the cutting edge 158 of which is serrated. A cam 160 is fixed to a portion 186 (FIG. 5 and 11) of the bracket 150 near its mounting on shaft 46. Cam 160 has an outwardly projecting cam section 162 that cooperates with a roller 164 (FIGS. 5 and 10) mounted on the end of a longitudinally reciprocating arm or piston 166. Arm 166 is slidably mounted in a housing 168 that is fixed to applicator body plate 32. Roller 164 is pulled downwardly against the cam surface by means of a tension spring 170, the latter being connected to a pin on the arm 166 and to a pin 174 on the cam 160. To facilitate free pivotal motion of the pressure foot bracket 150, the pivot shaft 46 extends through a headed bushing 175 (FIG. 11), which extends through aligned apertures in cam 160 and in bracket portion 186 and has its inner end received in a spacer disc 176.

Spacer disc 176 is fixed to the outside of body plate 32 and carries an outwardly projecting pin 180 (FIG. 11) that is received in an arcuate slot 82 formed in bracket portion 186. The pin 180 and slot 82 provide motion limiting stops for the pivotal motion of the bracket, which thus is enabled to move from an extended position illustrated in FIG. 5 to a folded position illustrated in FIG. 6. Stated otherwise, bracket motion toward each of these positions is limited by the cooperating and interengaging stop pin and slot 180 and 82.

The described cam and spring arrangement effects holding of the pressure foot 152 and its integral mounting bracket 150 in the extended position of FIG. 5, with the spring 170 then being to the right (as seen in FIG. 5) of the pivot axis of the pin 46 about which the bracket is pivoted. Pressure on the end of the bracket, tending to move the bracket in a clockwise direction (as viewed in FIG. 5 and 10), if sufficiently great, causes roller 164 to ride up over the projecting cam end 162. This further tensions the spring 170 until the peak of cam portion 162 passes the roller, at which point the pin 174 has moved sufficiently clockwise so that the spring extends along a line on the other side of the axis of pin 46. The spring 170 then to snap the pressure foot all the way to its folded position of FIG. 6 (the folded position of the cam being also shown in dotted lines in FIG. 5). By grasping the end of the pressure foot 152 and moving the pressure foot and bracket 150 in a counter clockwise direction, the bracket and pressure foot may be moved to the extended position, shown in FIG. 5, which the bracket is held by the spring and cam interaction.

Pressure foot 152 has secured to its outer surface a resilient pressure pad 194 under which tape 16 passes as it comes off the pressure/power roller 44 when the bracket is in its extended position.

A releasable tape end holding spring 200 (FIG. 12) straddles the pressure foot at a location somewhat inwardly of the cutting blade 156. The spring is captured in slots 203,205 of the pressure foot. Spring 200 includes angulated side portions 202,204,206,208 interconnected by an outwardly bower bridge member 210. The holding spring 200 is preferably made of a stiff, resilient metal. End portions 204,208 of the holding s spring project for a small distance inwardly of the side edges of pad 194. This pad and the pressure foot end 152 have a width substantially equal to the width of the tape (the pressure foot being slightly wider), and thus the tape as it extends under the pressure foot and along the surface of the pad has its lateral edges held in position by the angulated legs 202,204,206,208. Importantly, the tape end portion is held against the outer surface of the pad 194 at a point close to the cutting blade 158.

A hole 214 (FIG. 11) extends completely through both the pressure foot 152 and pad 194, and is centered at about one and one-half inches from the cutting edge 158 of blade 156. This hole enables the tape to be drawn out so that the leading edge of a stud location mark 28 on the tape (which mark may be hidden from view because it is on the side of the tape facing the pad 194) will be precisely at the cutting edge 158 of the pressure foot cutter 156 when the trailing side of the same tape mark is visible through the hole 214. It will be recalled that each mark has a length of one and one-half inches, which is substantially equal to the width of a conventional two-by-four. Therefore, the trailing edge of the mark on the tape will appear at the center of hole 214 when the leading edge of the same mark is precisely at cutting blade 156, which is one and one-half inches from the center of hole 214.

It will be understood that the described tape applicator may be employed in many different situations and building configurations for laying down a line of tape. The tape can be started precisely at a selected position to simply, easily, rapidly and accurately locate stud position marks. Importantly, the pressure foot 152 facilitates start of the tape end, and therefore location of the first stud locating mark of the tape, precisely at the desired position. This is always more difficult for an overhead operation.

FIG. 5 shows use of the pressure foot to start laying tape from a transverse wall 230. Use of the described applicator in an overhead application is illustrated in FIGS. 13*a*, 13*b* and 13*c* as an explication ample of a method of use of the described tool and described below.

In use of the described applicator, cover 33 is opened, and a roll of the described tape, having stud locating marks on one side and pressure sensitive adhesive on the other, is mounted on spindle 29. The end of the tape is then inserted into the junction between drive rollers 39 and 56. Power/ pressure roller 14 is then turned by hand or by moving the applicator along a surface while pressing it on such surface. The latter rotating the power/pressure roller 44, and via gears 42,48, effects a driven rotation of tape drive rollers 39,56. This rotation pulls the tape end between the drive rollers, thereby withdrawing tape from the supply roll. If deemed necessary or desirable, the rotatable mounting of primary drive roller 39 is provided with a one-way clutch to permit withdrawal of tape but to prevent reverse rotation of the primary drive roller. As rotation of the drive rollers 39,56 continues, tape is driven past the cutting station, being guided by the fingers 108,110, and 112 over cutter block 104 and cutter blade 102. The tape then projects from the housing over the periphery of the pad 60 on the outside side of the inner portion 44 of power/pressure roller 14.

Figure 12:
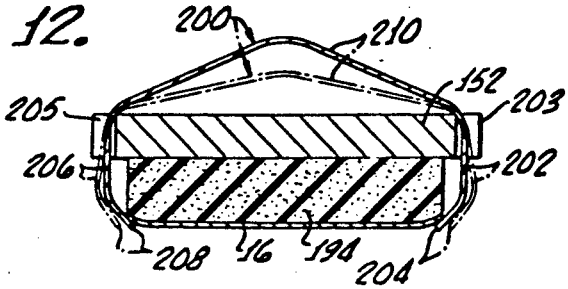
FIG. 12 is a section taken on line 12—12 of FIG. 10.

The roller 14 is rotated sufficiently far to cause enough tape to be projected so that the free end of the projected tape then may be manually entrained over a portion of the outer periphery of the power/pressure roller and brought along the surface of the pressure foot and its pad 194, the pressure foot being in its extended operating position, as is illustrated in FIG. 5. The side edges of the tape are pushed under the outer legs 204,208 of holding spring 200 (as shown in FIG. 12) to hold the end of the tape closely against the pressure pad 194. Withdrawal of the tape from the roll is then continued while observing the marked surface of the tape through the hole 214.

When the trailing edge of one of the stud locating marks 28 on the tape appears within the hole 214, it is known that the leading edge of this mark is at the cutting edge 158 of pressure foot cutter 156. This position of the tape is known even though it may be difficult or impossible to see the leading edge of the mark (which faces the pad) because of the proximity to the pad of the tape surface that bears the marks. With the first tape stud locating mark properly positioned, that end of the tape which projects beyond the cutting edge 158 is removed by pulling the tape end against the cutting edge 158. This leaves the leading edge of the first stud locating mark precisely located at the free end of pressure foot 152. Accordingly, by positioning the free end of pressure foot 152 at any desired location of the first stud, and pressing the pressure foot against a member to which the tape is to be applied, the tape adhesive secures the end of the tape, and thus the first stud locating mark, precisely in the desired position.

If tape is to be applied to an overhead track, such as track 220 of FIG. 13*a*, which abuts against an existing transverse wall 222, it is generally desired to have the first stud located precisely at or against the existing wall 222. Accordingly, the applicator is raised above the head of the user, who holds the handle at a convenient height, somewhat in the manner illustrated in FIG. 2, such that the pressure foot 152 is pressed against the inside of the downwardly facing track 220, with the free end of the pressure foot, e.g. the blade 156, abutting the surface of the existing wall 222. Conveniently, the axis of the applicator handle extends downwardly and away from the wall 222 to provide room for the operator to manipulate the applicator. The pressure foot is in extended position with the tape severed at the pressure foot end and with the first tape mark positioned at the pressure foot end.

The handle of the applicator is then pushed upwardly, in the direction of arrow 224, thereby causing the tape, which is interposed between the pressure foot 152 and a downwardly facing surface of the track 220, to be adhesively secured to the track surface adjacent the end of the tape. Continued upward pressure in the direction of arrow 224 will rotate the pressure s foot, and thus its cam 160, in a clockwise direction, as viewed in FIG. 13*a*, causing the spring 170 to snap over center and, with a rapid action, fold the pressure foot 152 to the side of the applicator body, where it rests in the folded position illustrated in FIG. 6 and FIG. 13*b*.

During this inward folding motion of the pressure foot, the applicator is not moved along the track 220, and the power/pressure roller 14 therefore does not rotate. Thus no further tape is payed out from the tape supply as the pressure foot snaps to its folded position. However, as the pressure foot snaps to its folded position, the end of the pressure foot, together with the holding spring 200, move past the free end of the tape. In other words, as the pressure foot and holding spring rotate to folded position, no more tape is withdrawn, and the pressure foot and holding spring pull away from and clear of the tape. Thus the snap action folding of the pressure foot, moving from the position of FIG. 5 to the position of FIG. 6, effectively pulls the pressure foot and the holding spring 200 over the free end of the tape and pulls the pressure foot and its holder completely clear of the tape.

The very end of the tape is therefore free of the pressure foot, not being secured to and pressed against the surface of track 220. However, that portion of the tape between the power roller 14 and an intermediate portion of the pressure foot, adjacent the holding spring 200, has been firmly pressed against the surface of track 220. Thus this portion of the tape is firmly secured by means of its adhesive to the track surface. The tape and applicator are now in the position illustrated in FIG. 13*b*. The pressure foot is folded free of the tape end which is firmly secured to the track in proper position. The operator may now simply walk beneath the track 220, continuing to press the applicator upwardly, concomitantly withdrawing additional tape from the supply roll and adhesively securing it to the downwardly facing track surface. It will be noted that, initially, handle 20 is pointed downwardly and outwardly, away from wall 222, because of the lack of clearance, and thus initially the operator will be pulling the applicator away from the pre-existing wall 222. When the applicator gets to a position sufficiently far from the wall 222, the inclination of the handle 220 may be changed so as to project downwardly toward the wall 222. As shown in FIG. 13*c*, the operator now continues to apply the tape by walking forwardly, pushing the applicator ahead of him as he presses it upwardly against the track 220.

Where a line of studs is to be laid out between two existing walls or having one end adjacent an existing wall, the tape is applied as previously described, first leaning the handle away from a first wall near a starting end of the tape and pulling the applicator while applying the tape, then leaning the applicator handle toward the first wall and continuing to apply tape by pushing the applicator until the power/pressure roller reaches a point close to but not yet at the last stud location, which may be precisely at an existing wall. Tape application with use of the applicator is stopped within a distance that is not greater than the selected stud spacing, so that, for a wall having conventional sixteen inch stud spacing, the applicator is stopped-at a distance that is less than sixteen inches from the end wall.

The tape is cut by pulling the trigger 94, using the cutting blade 102 within the applicator housing. The remaining end of the tape is then withdrawn from the applicator housing and pressed down on the plate or track. A stud locating mark 28 is not used for the last stud. It is not necessary to provide a mark for the final stud in such a situation, because such final stud will be positioned at the existing wall, which is at the end of the plate or track, even though spacing between such final stud and the last marked stud is less than sixteen inches.

Handle 20 is articulated about pivot 26, as shown in FIG. 14, in order to enable the plane of the applicator to be pivoted relative to the axis of the handle, and to enable the parts to be locked in either angulated or straight position. This will enable the applicator to apply tape to a surface that is not readily or conveniently accessible to the applicator with a straight, unbent handle For example, if it is desired to apply the tape strip to a vertical surface on the side of a track or plate member 240 (FIG. 15), it is convenient to bend the applicator handle about the pivot 26 and to lock the pivoted handle in this angular position. The apparatus may s then be moved to apply tape along the vertical surface, whether adjacent the floor or above the operator's head, with the handle still remaining somewhat vertical.

The preferred embodiment described herein employs the movable pressure foot for starting application of the tape and facilitating location of the first stud locating mark of the tape at a selected point. The described arrangement also includes a powered drive for withdrawing tape from the roll so that tension between the roll and the previously applied and adhesively secured portion of the tape is not the force that pulls the tape from the roll. However, for certain situations and to provide a, less expensive apparatus, some parts of the present invention may be applied to a tape applicator which may be in part similar to what is described and illustrated herein, but which omits the pressure foot and the tape roll driving rollers. In such an arrangement the tape is entrained over the pressure roller 14, which is no longer a power roller, and is used solely as a pressure roller to press the tape down along a surface One or more idler rollers may be employed between the pressure roller and the tape roll to guide the tape from the supply roll to the pressure foot in such a simplified arrangement.

It will be readily understood that the handle 20 may have any suitable length and may be made extensible and collapsible, as, for example, by being provided with a pair of telescopically connected handle elements, to enable the handle to vary in length from a few feet to as much as ten feet or more. The tape may thus be applied to a track on a ceiling as high as fourteen feet or more, while the user stands and walks on the floor below the track.

There have been described methods and apparatus which facilitate marking of stud locations by providing stud locating marks rapidly, easily, with minimum effort and assured precision for both upper and lower ends of the studs of a structural wall. Costly errors are eliminated, and both time and expense are saved. The stud locating marks provided are clearly visible, whether on a lower plate or track or even on the top plate or track of a high wall.

The foregoing detailed description is to be clearly understood as given by way of illustration and example only, the spirit and scope of this invention being limited solely by the appended claims.

What is claimed is:

1. A method for marking locations of building elements in a wall of a building, comprising the steps of:

providing a roll of tape having adhesive on one side and a plurality of locating marks on the other side, mounting the tape roll in a tape applicator having a pressure foot extending therefrom, positioning the tape on one side of the pressure foot with an outer most end of the pressure foot at a known distance from one of said locating marks of the tape, said step of positioning the tape on one side of said pressure foot comprising withdrawing tape from said roll until said one locating mark is aligned with said pressure foot end, holding the end of said tape at said pressure foot end, and severing the tape at said pressure foot end, positioning the pressure foot end adjacent a member to be marked at a start position on said member that is a known distance from a desired first building element location, pressing the tape against said member adjacent said start position to secure a leading portion of the tape to the member with said one locating mark at a known distance from said first location, moving the applicator along said member, and withdrawing tape from the roll as the applicator is moved, while pressing the tape against said member.

2. The method of claim 1 including the step of releasing the tape from said pressure foot end.

3. The method of claim 1 including the step of retracting the pressure foot and releasing the tape from said pressure foot end.

4. Apparatus for laying out locations of studs for a building, which studs are to be secured with one end thereof adjacent a structural member having a stud location start position, said apparatus comprising:

a tape applicator body, a roll of tape rotatably mounted to said body, said tape having a plurality of location marks on one side mutually spaced by predetermined distances, and having adhesive on the other side, a pressure foot secured to said body and having a locating end, means for guiding an end of said tape to the pressure foot with an edge of one of said location marks of the tape positioned at said pressure foot locating end, whereby said pressure foot end may be positioned at said location start position to thereby position said one location mark of the tape at said location start position, and means for releasably holding an end of said tape against the pressure foot adjacent said pressure foot locating end.

5. The apparatus of claim 4 including means responsive to pressure exerted on the pressure foot for retracting the pressure foot and releasing the tape from the pressure foot.

6. The apparatus of claim 4 including means on the pressure foot locating end for cutting said tape at said locating end.

7. Apparatus for laying out locations of studs for a building, which studs are to be secured with one end thereof adjacent a structural member having a stud location start position, said apparatus comprising:

a tape applicator body, a roll of tape rotatably mounted to said body, said tape having a plurality of location marks on one side mutually spaced by predetermined distances, and having adhesive on the other side, a pressure foot secured to said body and having a locating end, and means for guiding an end of said tape to the pressure foot with an edge of one of said location marks of the tape positioned at said pressure foot locating end, whereby said pressure foot end may be positioned at said location start position to thereby position said one location mark of the tape at said location start position, said means for guiding comprising a power roller rotatably mounted on said body, and means responsive to said power roller for withdrawing tape from said roll of tape and feeding withdrawn tape to said power roller, whereby tape entrained over said power roller is guided and driven to said pressure foot.

8. Apparatus for laying out locations of studs for a building, which studs are to be secured with one end thereof adjacent a structural member having a stud location start position, said apparatus comprising:

a tape applicator body, a roll of tape rotatably mounted to said body, said tape having a plurality of location marks on one side mutually spaced by predetermined distances, and having adhesive on the other side, a pressure foot secured to said body and having a locating end, and means for guiding an end of said tape to the pressure foot with an edge of one of said location marks of the tape positioned at said pressure foot locating end, whereby said pressure foot end may be positioned at said location start position to thereby position said one location mark of the tape at said location start position, said means for guiding including a power/pressure roller rotatably mounted to said applicator body and having a peripheral edge projecting from the applicator body for frictional engagement with said structural member to cause said roller to be rotated as the applicator body is moved along a contacting surface of such member with the roller in contact with said surface, a tape drive roller rotatably mounted in the body, a driving connection between said power/pressure roller and said tape drive roller, means coupled with the tape drive roller for withdrawing tape from said supply roll, and means on said body for severing the tape.

9. The apparatus of claim 8 including means on the end of said pressure foot for severing said tape at said pressure foot end.

10. The apparatus of claim 8 wherein said pressure foot is mounted to said body for motion between extended and retracted positions, and including over center spring means for releasably holding said pressure foot in each of said positions.

11. The apparatus of claim 8 wherein said pressure foot includes a bracket secured to the pressure foot and pivotally connected to said applicator body for motion between extended and retracted positions, means adjacent said pressure foot end for holding an end of the tape against an outer surface of the pressure foot in extended position, and means for moving the bracket to retracted position and releasing the tape end from the pressure foot.

12. The apparatus of claim 1 including latch means for holding said bracket in an outer position displaced from said body, spring means for urging the bracket to a folded position adjacent said body, said first mentioned means including means for releasing the holding of said bracket in outer position in response to a force exerted on the pressure foot.

13. Apparatus for laying out a series of positions to locate ends of a plurality of studs that will form a structural wall or the like, said apparatus comprising:

an applicator housing, a power roller rotatably mounted to the housing and having a peripheral edge portion protruding therefrom, a primary tape drive roller rotatably mounted in the housing, a driving connection between the power roller and the tape drive roller, a secondary drive roller rotatably mounted in the housing, spring means for urging the drive rollers toward each other, a tape supply roll rotatably mounted in the housing and carrying a roll of tape, said tape having adhesive on one side thereof and a plurality of stud location marks on the other side thereof, said tape extending between said drive rollers to be driven thereby, a cutting device mounted to the applicator housing between the power roller and the drive roller, pressure foot pivoted to the housing for motion between a retracted position in which it extends along and adjacent said housing, and an extended position in which it projects from the housing at an angle with respect to the housing, said pressure s foot having a locating end adapted to be positioned at a desired location of a first one of a plurality of studs, said tape have a portion entrained over said power roller and adapted to extend along said pressure foot, and means on the pressure foot for holding said tape at said pressure foot locating end when said pressure foot is in said extended position.

14. The apparatus of claim 13 including means for releasably holding said pressure foot in each said position.

15. Apparatus for laying out locations of studs for a building, which studs are to be secured in a line with one end thereof adjacent a structural member having a first stud locating position, said apparatus comprising:

a tape applicator body, a handle on said body, a roll of tape rotatably mounted to said body, said tape having a plurality of stud location marks on one side thereof mutually spaced by predetermined distances and having pressure sensitive adhesive on the other side thereof, whereby an end of said tape may be withdrawn from said roll to place one of said stud location marks at said first stud locating position and said applicator body may be moved by said handle to move the body and tape roll along said line while pressing the body against the member to adhesively secure a section of tape to the member, a pressure foot mounted to the body for motion between a start position displaced from the body and an application position adjacent the body, and means for guiding tape withdrawn from the roll over said pressure foot in said start position, and means for holding an end of said tape at said end of said pressure foot, said pressure foot having a free end positioned outwardly of said body in said start position.

* * * * *